US005806477A

United States Patent [19]

Regueiro

[11] Patent Number: 5,806,477

[45] Date of Patent: Sep. 15, 1998

[54] QUIET CONNECTOR BETWEEN ROCKER ARM AND VALVE STEM

[75] Inventor: Jose F. Regueiro, Rochester Hills, Mich.

[73] Assignee: Chrysler Corporation, Auburn Hills, Mich.

[21] Appl. No.: 823,930

[22] Filed: Mar. 25, 1997

[51] Int. Cl.[6] ..... F01L 1/26

[52] U.S. Cl. ..... 123/90.22; 123/90.39; 123/90.41

[58] Field of Search ..... 123/90.22, 90.27, 123/90.39, 90.4, 90.41, 90.42, 90.43, 90.44, 90.48, 90.49; 74/519, 559, 569

[56] References Cited

U.S. PATENT DOCUMENTS

| | | | |
|---|---|---|---|
| 4,979,475 | 12/1990 | Mills | 123/90.39 |
| 4,986,227 | 1/1991 | Dewey, III | 123/90.39 |
| 5,159,906 | 11/1992 | Fontichiaro et al. | 123/90.18 |
| 5,570,665 | 11/1996 | Regueiro | 123/90.27 |
| 5,622,146 | 4/1997 | Speil | 123/90.22 |
| 5,645,023 | 7/1997 | Regueiro | 123/90.22 |
| 5,651,337 | 7/1997 | Regueiro | 123/90.27 |
| 5,669,344 | 9/1997 | Regueiro | 123/90.22 |
| 5,682,849 | 11/1997 | Regueiro | 123/90.22 |

*Primary Examiner*—Weilun Lo
*Attorney, Agent, or Firm*—Kenneth H. MacLean

[57] ABSTRACT

A connector member for a valve train mechanism of an internal combustion engine and in which the connector member takes the form of a separate element shaped as a block that is inserted within the grooved bottom end of one arm of a crosshead or the arm of a finger follower and provides surface-to-surface engagement with the side walls of the groove within the crosshead or finger follower so as to prevent rattles between the two parts and has the bottom surface of the connector provided with an opening which serves to accommodate the terminal end of a valve stem.

5 Claims, 2 Drawing Sheets

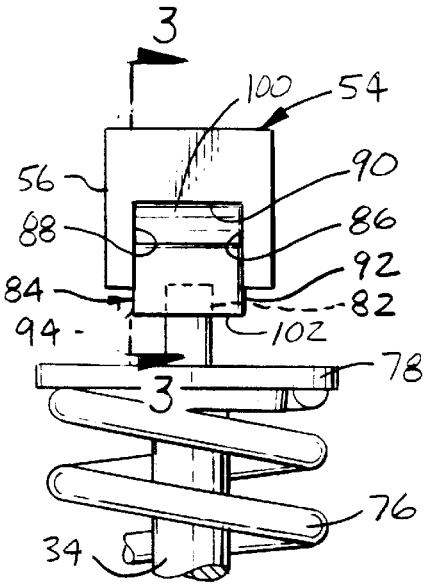
FIG-2
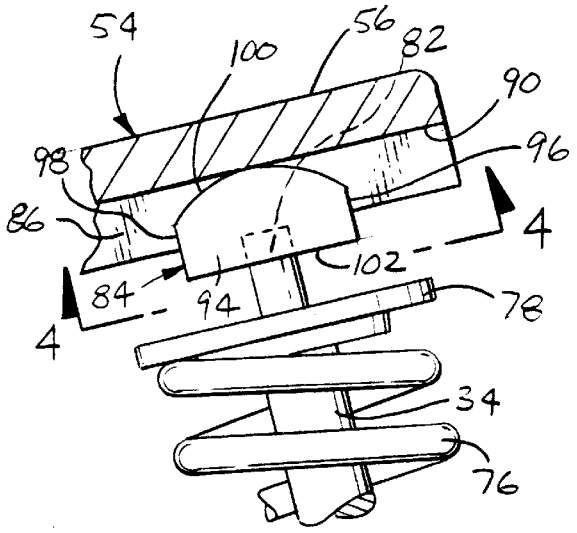
FIG-3
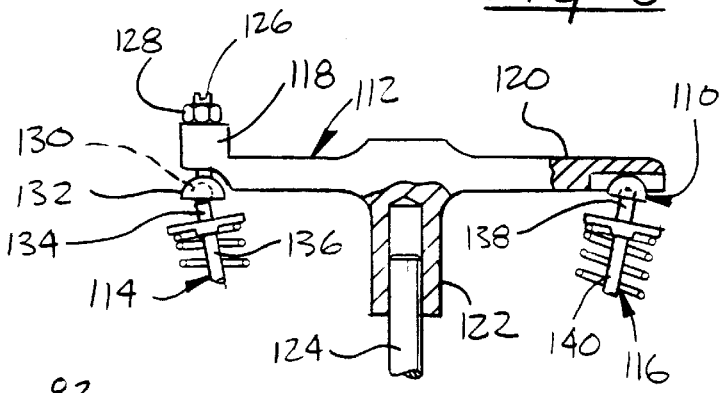
FIG-5
FIG-4
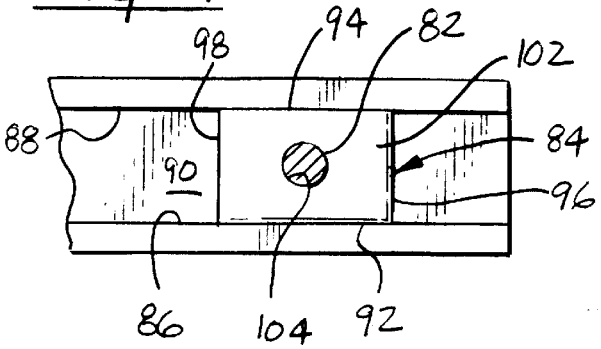
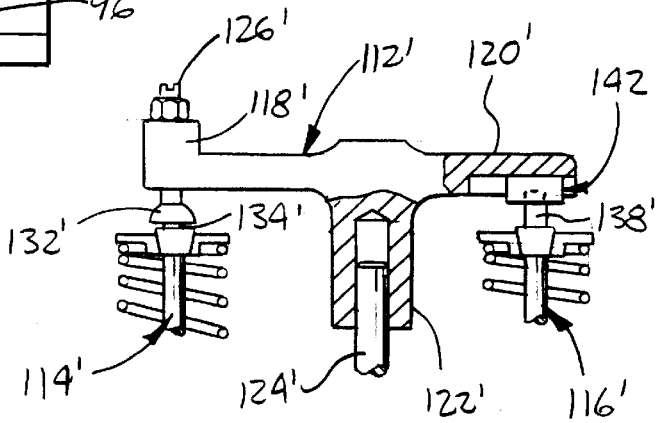
FIG-6

QUIET CONNECTOR BETWEEN ROCKER ARM AND VALVE STEM

FIELD OF THE INVENTION

This invention concerns valve train mechanisms and more particularly relates to a connector member that is interposed between a valve actuator and the top end of a valve stem for providing a connection between the actuator and the valve stem which does not create any objectionable noise.

BACKGROUND OF THE INVENTION

In some past designs of valve train mechanisms of internal combustion engines, a grooved end at the bottom of a finger follower or the bottom of one arm of a crosshead engages a cylindrical top end of the valve stem so as to use the connection between the two elements as an anchor point. As a result, the crosshead or the finger follower is permitted to maintain its position relative to the top end of the valve stem even though the end opposite the grooved end of the finger follower may be supported by a ball joint or the crosshead is supported by a guide pin. One problem with this type of arrangement is that there is a line contact and a slight clearance between each side wall of the groove of the finger follower or crosshead and the cylindrical end of the valve stem. Thus, even if oil is present, the line contact tends to break down the oil film as the crosshead or the finger follower tends to oscillate sideways at a very high frequency about its support pivot resulting an objectionable buzzing sound.

SUMMARY OF THE INVENTION

Accordingly, one object of the present invention is to provide a new and improved connector member which interconnects the grooved end at the bottom of a finger follower or the bottom of one arm of a crosshead of a valve train mechanism and which serves to stabilize the finger follower and the crosshead about its support pivot and tends to eliminate objectionable noise during the operation of the valve train mechanism by providing an enlarged surface-to-surface contact between the side walls of the connector member and the side walls of the accommodating groove.

Another object of the present invention is to provide a new and improved connector for a valve train mechanism of an internal combustion engine and in which the connector takes the form of a separate member shaped as a block that is inserted within the grooved bottom end of one arm of a crosshead or one end of a finger follower and provides surface-to-surface engagement with the side walls of the groove within the crosshead or finger follower and has the bottom surface of the connector provided with a circular hole which serves to accommodate the top end of a valve stem.

A further object of the present invention is to provide a new and improved connector member for a valve train mechanism of an internal combustion engine and in which the connector member takes the form of a block and has a curved upper wall engaging the flat top wall of a groove formed in one end of an actuator and has a pair of parallel contact walls in surface-to-surface engagement with the side walls of the groove and has a flat bottom wall provided with a round opening which receives the terminal end of a valve stem.

A still further object of the present invention is to provide a new and improved connector member for a valve train mechanism of an internal combustion engine and in which the connector member takes the form of a block and has a flat upper wall engaging the flat top wall of a groove formed in one arm of a crosshead and has a pair of parallel contact walls in surface-to-surface engagement with the side walls of the groove and has a flat bottom wall provided with a round opening which receives the terminal end of a valve stem.

Stated broadly, the above and other objects of the present invention are realized in accordance with the present invention by a connector member which is incorporated in a valve train mechanism located in the cylinder head of an internal combustion engine. The valve train mechanism includes camshafts and exhaust and intake valves the latter of which are transversely inclined and mounted in the cylinder head for movement between an open position and a closed position. Each of the valves has a valve stem and is provided with a spring for biasing the valve into the closed position. In one form of the invention, the connector member is part of an actuator which is operatively combined with each of the valves. Also, the actuator takes the form of a finger follower having one end supported by a ball joint on the cylinder head and the other end located adjacent the terminal end of the valve stem of the associated valve. The other end of the finger follower is formed with a groove defined by a pair of parallel side walls and a planar top wall. In another form of the invention, the actuator is a crosshead driving a pair of same-function valves with one arm of the crosshead provided with a groove as described above. In each case, the connector member is located in the groove and is formed with a pair of side contact walls which are in surface-to-surface engagement with the pair of side walls of the groove. In addition, the connector member is provided with a curved upper wall which engages the top wall of the groove and has a bottom wall provided with a hole accommodating the terminal end of the valve stem. The camshaft associated with the actuator has a cam adapted to engage the intermediate portion of the actuator so as to cause the latter to move downwardly and act through the connector member to urge the valve to the open position against the bias of associated spring.

In a modified form of the present invention, the connector member is incorporated within a groove formed in one arm of a crosshead which serves to control the motion of a pair of same-function valves which are disposed parallel to each other. In this case, the connector member takes the form of a rectangular block having an upper or top wall and a bottom wall and a pair of laterally spaced parallel contact walls positioned on opposite sides of the block. Also, the bottom wall is provided with a hole which serves to accommodate the round terminal end of the associated valve. Inasmuch as the valves are disposed parallel to each other, the upper wall of the connector member as well as the side contact walls thereof maintain surface-to-surface contact with the side walls and the top wall of the associated groove in the crosshead during the operation of the valve system.

BRIEF DESCRIPTION OF THE DRAWINGS

Other objects, advantages, and features of the present invention will become apparent from the following detailed description of the invention when considered in conjunction with the following drawings in which:

FIG. 2 is an enlarged view taken on line 2—2 of FIG. 1 showing the connector member interposed between one of the valve actuators and the top of the associated valve stem;

FIG. 3 is a view taken on line 3—3 of FIG. 2;

FIG. 4 is a view taken on line 4—4 of FIG. 3;

FIG. 5 is a view of a connector member employed according to the present invention with a valve train mechanism having a crosshead as the valve actuator; and FIG. 6 is a view of a modified connector member employed according to the present invention with a valve mechanism having a crosshead actuating a pair of same-function valves with their valve stems disposed parallel to each other.

DETAILED DESCRIPTION OF THE INVENTION

Figure 1:
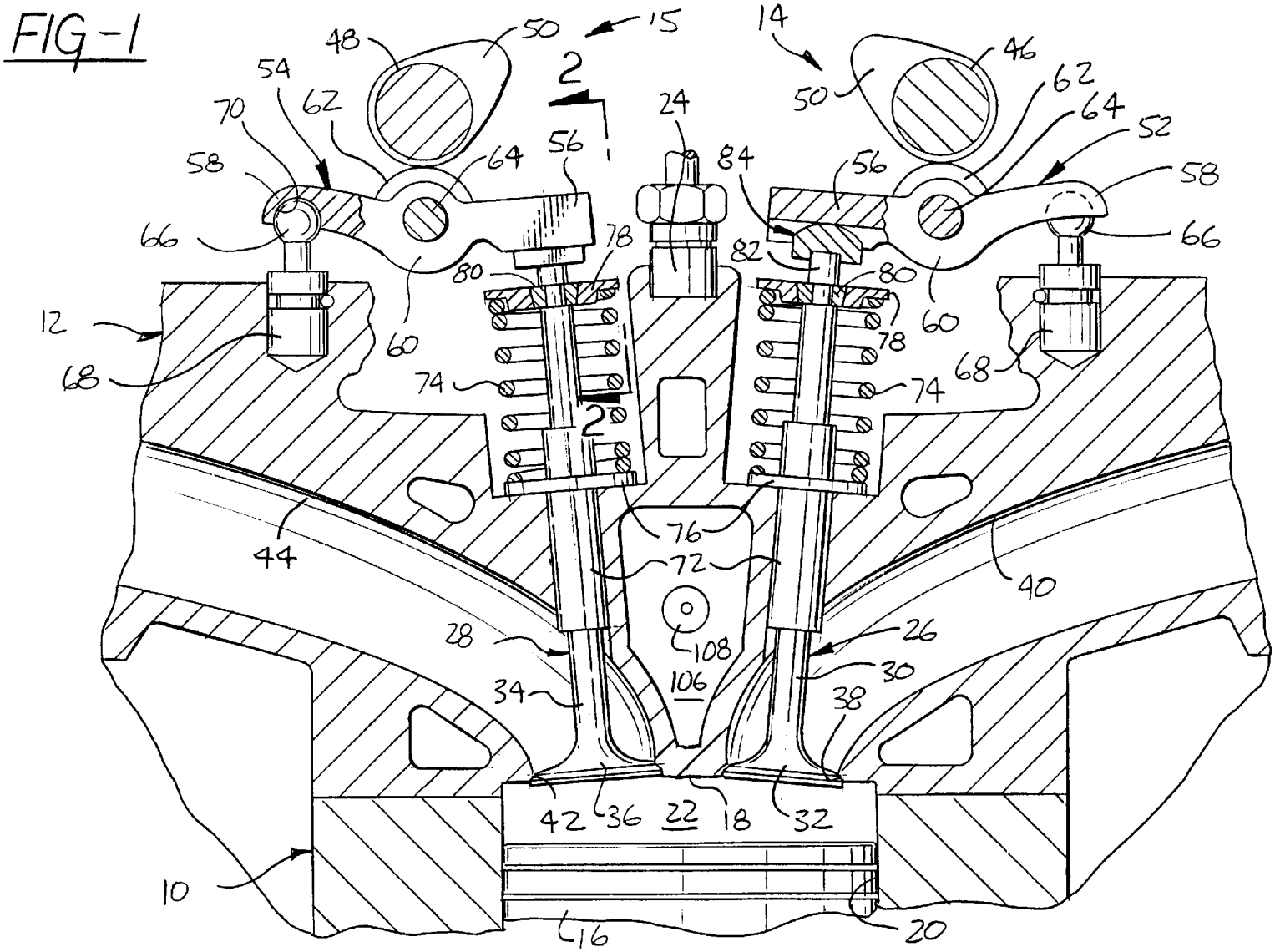
FIG. 1 is a view partially in section of a cylinder head incorporating a valve train mechanism including intake and exhaust valves which employ a connector member in accordance with the present invention.

Referring now to the drawings and more particularly to FIG. 1 thereof, a single cylinder of a multi-cylinder engine is shown having an engine block 10 on which is secured by fasteners (not shown) a lower portion of a cylinder head 12 that incorporates a pair of identical valve train mechanisms 14 and 15.

Each of the cylinders of the engine houses a piston 16 which moves axially along the longitudinal center axis of the associated cylinder and has the lower end thereof connected to the engine crankshaft (not shown) by a connecting rod (not shown). The cylinder head 12 is formed with a pent roof surface 18 providing a recess which is aligned with the bore defining the associated cylinder 20 and together with the top of the piston 16 form a combustion chamber 22 which varies in volume during the operation of the engine. In this instance, a fuel injector 24 is threadably secured in the cylinder head 12 centrally of the recess 18 along the longitudinal center axis of each cylinder 20. As will become apparent as the description of the present invention proceeds, the valve train mechanisms 14 and 15 according to the present invention can also be used with a spark ignition internal combustion engine.

As best seen in FIG. 1, the cylinder head 12 is provided with an intake valve 26 and an exhaust valve 28 both of which are located in side-by-side relationship. The intake valve 26 has a valve stem 30 the lower end of which is formed with a round valve head 32. Similarly, the exhaust valve 28 has a valve stem 34 the lower end of which is formed with a round valve head 36. As is conventional, the intake valve head 32 is normally seated in a valve seat 38 formed in the cylinder head 12 that defines a round opening or port of an intake passage 40 formed in the cylinder head 12. Also, the exhaust valve head 36 is normally seated in a valve seat 42 formed in the cylinder head 12 that defines a round opening or port of an exhaust passage 44 formed in the cylinder head 12.

It will be noted that the valve stem 30 of the intake valve 26 and the valve stem 34 of the exhaust valve 28 are inclined along the transversal plane with the longitudinal center axis of the valve stem 30 of intake valve 26 and the longitudinal center axis of the valve stem 34 of the exhaust valve 28 lying in a common plane which extends transversely of the engine and is perpendicular to the rotational axes of the camshafts 46 and 48.

In order to simplify the description of the invention, and inasmuch as the engine block 10 and the various operating components normally associated therewith are well known to those skilled in the art of engine design, a detailed showing and/or description of such parts and components is not being provided herein. Instead, the valve train mechanisms 14 and 15, employing connector members in accordance with the invention, will now be described in detail.

As seen in FIG. 1, a pair of laterally spaced overhead camshafts 46 and 48 are rotatably supported in the upper portion of the cylinder head 12 by a camshaft bearing saddle support and camshaft cap (neither of which are shown) which are secured by cap screws (not shown) in threaded holes disposed in the lower head portion of the cylinder head 12. Each of the camshafts 46 and 48 is supported for rotation about an axis that is substantially parallel to the rotational axis of the engine crankshaft and each camshaft 46 and 48 includes a plurality of cam lobes, (one of which is only shown and identified by reference numeral 50) for actuating the valves 26 and 28 through actuators such as finger followers 52 and 54.

In this regard, the finger followers 52 and 54 are identical in construction and each is formed as an elongated member having a head end 56 and a tail end 58 with an enlarged portion 60 intermediate the two ends that is provided with a roller 62 supported for rotation about a shaft 64 fixed to the body of the associated finger follower and providing rotation of the roller 62 about an axis parallel to the rotational axis of the camshafts 46 and 48. In addition, each finger follower 52 and 54 is adapted to pivot about the ball portion 66 of a conventional hydraulic lash compensator 68 that is slidably disposed in the cylinder head 12. The ball portion 66 is received by a spherical recess 70 formed in the finger follower body between the roller 62 and the tail end 58 of the associated finger follower. In order to assure that each finger follower 52 and 54 will pivot about the ball portion 66 along a plane perpendicular to the rotational axes of the camshafts 46 and 48 and not lose its position relative to the associated valve stem, the head end 56 of each finger follower 52 and 54 is formed with an elongated groove which extends along the longitudinal axis of the associated finger follower and which will be more fully described hereinafter.

Both the intake valve 26 and the exhaust valve 28 have their respective stems 30 and 34 extending upwardly from the associated valve head and passing through a guide sleeve 72 secured to the cylinder head 12 that supports the associated valve for linear reciprocal movement. Each of the valves 26 and 28 is normally maintained in a closed position by a compression spring 74, the lower end of which is seated on a spring-base washer 76 disposed in a spot-faced recess in the cylinder head 12. The upper end of the spring 76 abuts a retainer 78 secured to the associated valve stem by a conventional two-piece lock 80 adjacent the cylindrical terminal end 82 of the valve stem.

It will be noted that a connector member 84 is interposed between the terminal end 82 of each valve stem 30 and 34 and the groove formed in the associated finger follower. Moreover, as best seen in FIGS. 2–4, in each case the groove is defined by a pair of parallel side walls 86 and 88 and a orthogonal planar top wall 90. The connector member 84 is located in the groove of the finger follower and takes the form of a rectangular block having a pair of parallel side contact walls 92 and 94, a front wall 96, a rear wall 98 which is parallel to the front wall 96, a top wall 100, and a bottom wall 102. The top wall 100 of each connector member 84 normally engages the top wall 90 of the groove and has a convex curved configuration. The bottom wall 102 of each connector member 84 has a circular hole or opening 104 formed centrally therein that serves to snugly accommodate the terminal end 82 of the associated valve stem. In addition, the distance between the side contact walls 92 and 94 of each connector member 84 is slightly less than the distance between the side walls 86 and 88 of the groove so as to allow the connector member 84 to be inserted within the groove and allow relative sliding movement between the two with sufficient clearance for maintaining an oil film therebetween. In so doing, essentially surface-to-surface engagement between the pair of side walls 86 and 88 of the groove and the contact side walls 92 and 94 of the associated connector member 84 is provided without having direct metal to metal contact between the side walls. In addition, the connector member 84 being located in the groove serves to prevent the associated finger follower from rotating about a vertical axis passing through the ball portion 66 of the hydraulic lash compensator 68 and losing its position relative to the associated valve.

It should be apparent from the above description that the intake valve 26 and the exhaust valve 28 are normally maintained in the closed position, as shown, by the associated compression spring 76. Thus, in operation, the rotation of the camshaft 46 serves to actuate the finger follower 52 which, in turn, depresses the associated valve through the connector member 84. This occurs as the cam lobe 50 of the camshaft 46 strokes the roller 62 of the finger follower 52 causing the head end 56 thereof to pivot downwardly about the ball portion 66. The downward movement of the head end 56 of the finger follower 52 causes the intake valve 26 to be opened so as to allow communication between the intake passage 40 and the combustion chamber 22 via the port 38. As the intake valve 26 moves downwardly under the urging of the finger follower 52, the head end 56 of the finger follower 52 moves in a plane which is perpendicular to a plane passing through the rotational axes of the camshafts 46 and 48. During this time the top wall 90 of the groove of the finger follower 52 maintains a line contact with the upper curved surface 100 of the connector member 84. In addition, the side contact walls 92 and 94 of the connector member 84 are in surface-to-surface engagement with the flat side walls 86 and 88 of the groove at the head end 56 of the finger follower 52 and there is relative sliding movement between the side walls. The surface-to-surface engagement between the side walls of the groove and the side walls of the connector member 84 tends to eliminate the "buzzing" sound mentioned hereinbefore because the oil film in the space between the two acts as a damper. In other words, the oil prevents metal to metal contact between the side walls of the connector member 84 and the side walls of the groove during the time that the finger follower is experiencing any high frequency sideways oscillation.

Inasmuch as the valve train mechanism 15 is a mirror image of the valve train mechanism 14, it will be understood that rotation of the camshaft 48 results in the same operation of the finger follower 54 and movement of the exhaust valve 28 as described above in connection with the valve train mechanism 14 and therefore needs not to be repeated herein.

FIG. 5 shows a connector member 110 which is structurally the same as the connector member 84 incorporated with the valve mechanisms 14 and 15. In this instance, the connector member 110 is used with a crosshead 112 which serves to actuate a pair of same-function valves 114 and 116 of a valve train mechanism. As is conventional, the crosshead 112 is "T" shaped and includes a pair of opposed and axially aligned arms 118 and 120 integrally formed with an orthogonal cylindrical base portion 122 supported for slidable up-and-down movement by a guide pin 124.

The arm 118 of the crosshead 112 has an adjusting screw 126 threaded therein and secured thereto by a nut 128 threadably received by the upper end of the screw 126. The lower end of the adjusting screw 126 is integrally formed with a ball member 130 located in a socket member 132 so as to provide a swivel joint (often referred to as an "elephant foot"). The socket member 132 has a flat bottom surface resting on the terminal end 134 of a valve stem 136 of valve 114 moveable along an axis located in a plane passing through the longitudinal center axis of the guide pin 124. The other arm 120 of the crosshead 112 is provided with a groove such as that located in the finger follower 54 of the valve train mechanism described above. Also, as in the case of the groove in the finger follower 54, the groove accommodates the connector member 110 which is identical in shape to the connector member 54 associated with the finger follower 54. Also, the bottom wall of the connector member 110 is formed with a circular opening which accommodates the terminal round end 138 of a valve stem 140 which forms a part of the valve 116. As in the case of valve 114, valve 116 is movable along an axis located in a plane passing through the longitudinal center axis of the guide pin 124. Although not shown, it will be also understood that the crosshead 112 is intended to be actuated by a rocker arm in a conventional manner for moving the valves 114 and 116 between open and closed positions. As in the case of the valve train mechanisms 14 and 15, the side walls of the connector member 110 has surface-to-surface engagement with the side walls of the groove in the arm 120 of the crosshead 112. In addition, the oil film normally located between the opposed side walls of the connector member 110 and the groove will prevent metal to metal contact between the opposed side walls and serve the same function as explained above in connection with the valve train mechanisms 14 and 15. Also, the connector member 110 and the accommodating groove provide a tongue and groove connection which allows the arms of the crosshead 112 to maintain proper positions relative to the valves 114 and 116 by preventing pivoting of the crosshead 112 about the guide pin 124.

FIG. 6 shows a modified form of a connector member 142 employed with a portion of a valve train mechanism which is similar to that seen in FIG. 5. Accordingly, the components seen in FIG. 6 which are structurally identical to the components seen in FIG. 5 are identified by the same reference numerals but primed. In this regard, it will be noted that one difference between the two arrangements seen in FIG. 5 and FIG. 6 is that the valve stems 136' and 140' are not inclined but instead have their longitudinal center axes disposed parallel to each other. Thus, by positioning the valves 114' and 116' along axes normal to the arms 118' and 120' of the crosshead 112', the top wall of the connector member 142 need not be curved but can be planar and have surface-to-surface contact with the top wall of the groove formed in the arm 120' of the crosshead 112'. In all other respects, the connector member 142 is the same as the connector member 110 employed with the crosshead 112.

Various changes and modifications can be made to the above described connector members without departing from the spirit of the invention. Such changes are contemplated by the inventor and he does not wish to be limited except by the scope of the appended claims.

The embodiments of the invention in which an exclusive property or privilege is claimed are defined as follows:

1. In a valve train mechanism of an internal combustion engine having a cylinder head, a camshaft supported for rotation in said engine, a valve mounted in said cylinder head for movement between an open position and a closed position, said valve having a valve stem and being provided with a spring for biasing said valve into said closed position, an actuator having a free end thereof provided with a groove defined by a pair of parallel side walls and a planar top wall, said actuator having a portion thereof spaced from said free end and being supported by said cylinder head, said groove being located adjacent the terminal end of said valve stem, the improvement of a connector member located in said groove of said actuator for sliding movement relative to said groove along an axis parallel to said planar top wall and being formed with a pair of contact walls in surface-to-surface engagement with said pair of side walls, said connector member having an upper curved wall engaging said planar top wall of said groove so as to provide line contact therebetween and having a bottom wall provided with an opening accommodating said terminal end of said valve stem, and said camshaft having a cam adapted to provide a valve lifting force to an intermediate portion of said actuator to cause said actuator to act through said connector member to move said valve to said open position against the bias of said spring.

2. In a valve train mechanism of an internal combustion engine having a cylinder head, an overhead camshaft supported for rotation by said cylinder head, a valve mounted in said cylinder head for movement between an open position and a closed position, said valve having a valve stem and being provided with a spring for biasing said valve into said closed position, a finger follower having one end pivotally supported by said cylinder head and the other end located adjacent the terminal end of said valve stem, said other end of said finger follower being formed with a groove defined by a pair of parallel side walls and a planar top wall, the improvement of a connector member located in said groove of said finger follower for sliding movement relative to said groove along an axis parallel to said planar top wall and being formed with a pair of contact walls in surface-to-surface engagement with said pair of side walls, said connector member having a curved upper wall engaging said top wall of said groove so as to provide line contact therebetween and having a bottom wall provided with an opening accommodating said terminal end of said valve stem, and said camshaft having a cam adapted to engage the intermediate portion of said finger follower to cause said finger follower to pivot about said one end thereof and act through said connector member to move said valve to said open position against the bias of said spring.

3. In a valve train mechanism of an internal combustion engine having a cylinder head, a (camshaft) rocker arm supported (for rotation) by said engine, a valve mounted in said cylinder head for movement between an open position and a closed position, said valve having a cylindrical valve stem and being provided with a spring for biasing said valve into said closed position, a crosshead provided with a pair of opposed arms supported by said cylinder head with one of said arms being located adjacent the terminal end of said valve stem, said one of said arms being formed with a groove extending along the length of said one of said arms, said groove being defined by a pair of parallel side walls and a top wall, the improvement of a connector member located in said groove of said one of said arms for sliding movement relative to said groove along an axis parallel to said planar top wall and being formed with a pair of parallel contact walls in surface-to-surface engagement with said pair of side walls of said groove, said connector member having a curved upper wall engaging said top wall of said groove so as to provide line contact therebetween and having a bottom wall provided with an opening accommodating said terminal end of said valve stem, and said (camshaft having a cam) rocker arm adapted to provide a valve lifting force to an intermediate portion of said crosshead to cause said crosshead to act through said connector member to move said valve to said open position against the bias of said spring.

4. In a valve train mechanism of an internal combustion engine having a cylinder head, an overhead camshaft supported for rotation by said cylinder head, a valve mounted in said cylinder head for movement between an open position and a closed position, said valve having a cylindrical valve stem and being provided with a spring for biasing said valve into said closed position, a finger follower connected at one end by a universal joint to said cylinder head and having the other end located above the terminal end of said valve stem, said other end of said finger follower being formed with an elongated groove extending along the length of said rocker arm, said groove being defined by a pair of parallel side walls and a flat top wall, a connector member located in said groove of said finger follower for sliding movement relative to said groove along an axis parallel to said flat top wall and for preventing the (latter) finger follower from rotating sideways about said universal joint, said connector member being formed with a pair of laterally spaced and parallel contact walls in surface-to-surface engagement with said pair of side walls of said groove, a curved upper wall provided on said connector member for engagement with said top wall of said groove for providing line contact therebetween, said connector member having a planar bottom wall provided with a opening, said terminal end of said valve stem being located within said opening of said connector member, and said camshaft having a cam adapted to engage the intermediate portion of said finger follower to cause said finger follower to pivot about said one end thereof and act through said connector member to move said valve to said open position against the bias of said spring.

5. The valve train mechanism of claim 4 wherein said opening in said bottom wall of said connector member is circular in configuration.

* * * * *